United States Patent [19]

Hakansson

[11] 4,392,422

[45] Jul. 12, 1983

[54] APPARATUS FOR REMOVING LIQUID FROM A SUSPENSION

[75] Inventor: Sven Hakansson, Västerhaninge, Sweden

[73] Assignee: Axel Johnson Engineering AB, Nynaeshamn, Sweden

[21] Appl. No.: 275,994

[22] Filed: Jun. 22, 1981

[30] Foreign Application Priority Data

Jun. 25, 1980 [SE] Sweden ..... 8004701

[51] Int. Cl.[3] ..... B30B 9/24

[52] U.S. Cl. ..... 100/118; 210/344; 210/401

[58] Field of Search ..... 100/118, 119, 120, 121, 100/151, 152, 153, 154, 155; 210/384, 386, 400, 401; 162/360, 358

[56] References Cited

U.S. PATENT DOCUMENTS 4,142,461 3/1979 Bastgen ..... 100/118

4,159,947 7/1979 Brooks et al. ..... 100/118 X 4,172,416 10/1979 Hakansson ..... 100/118

FOREIGN PATENT DOCUMENTS 2363524 5/1978 France ..... 210/386

*Primary Examiner*—Peter Feldman

*Attorney, Agent, or Firm*—Brumbaugh, Graves, Donohue & Raymond

[57] ABSTRACT

In the embodiments of the web press disclosed in the specification, a pair of webs carries suspension material partly about a series of press drums of decreasing diameter in a first pressing section. One of the webs carrying the suspension material passes to a second press section where a further web replaces the other of the pair of webs to provide the inner web in a path around a press drum. Increased pressure is applied by a pressure belt to the webs as they pass around the press drum in the second pressing section.

5 Claims, 1 Drawing Figure

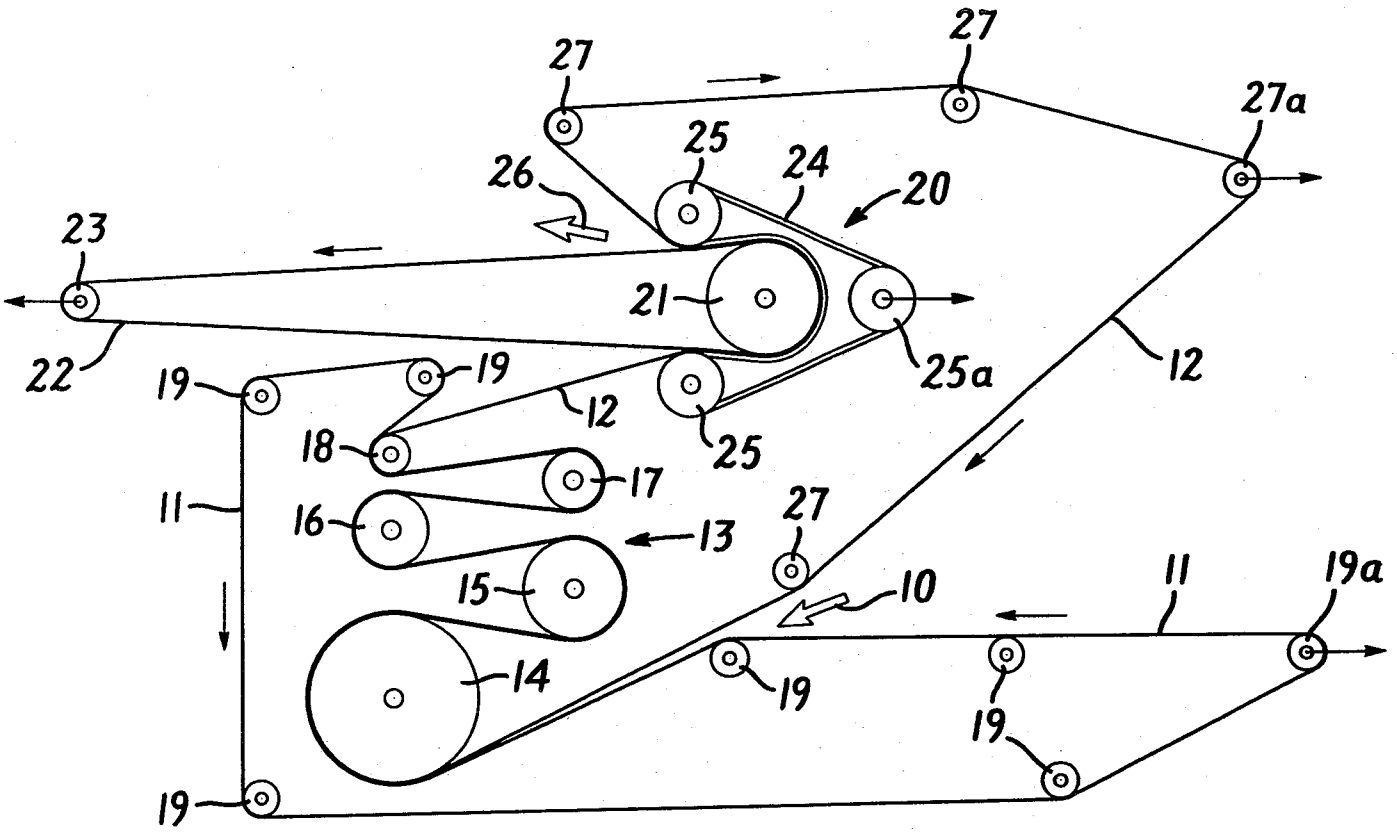
27a
27
27
12
20
24
25
26
25a
21
25
12
23
22
19a
11
19
10
27
19
13
17
18
16
15
14
19
19
11
19

APPARATUS FOR REMOVING LIQUID FROM A SUSPENSION

BACKGROUND OF THE INVENTION

The present invention relates to an apparatus or web press for removing liquid from a suspension during its transport between two webs which pass along a path extending partly around drums or rolls and, more particularly, to a new and improved apparatus for removing liquid from a suspension in which difficulties resulting from differences in the path lengths followed by the two webs are effectively eliminated.

In a web press wherein two webs follow a path extending partly around one or more drums or rolls, the webs usually have different path lengths. The web which is the inner web at the last drum usually has a shorter path length than the other web and the difference in the path lengths of the webs depends upon the thickness of the layer of suspension material between the webs. In some cases the difference in the path lengths of the webs is not significant since the webs are slightly extensible and usually are able to slide relative to the layer of suspension material and thereby relative to each other. In other cases, however, the webs are subjected to such a high pressure in passing around one or more of the drums that a sliding of a web relative to the layer of suspension material is not possible because of high frictional contact. In such cases, the inner web running closest to the drum tends to be too long and a surplus of that web is accumulated at the entrance to the drum.

SUMMARY OF THE INVENTION

The difficulties encountered as a result of different web lengths in a web press are overcome in accordance with the present invention by providing a web press wherein only one of the pair of webs carrying suspension material through the web press passes, as the outer web, around a drum which is subjected to high pressure. A separate web may be provided as an inner web for the drum which is subjected to high pressure or, if desired, the suspension material may be carried around that drum by only one web. More particularly, the web press of the invention comprises a pair of continuous webs movable over a portion of their length along a common path having an upstream end for introducing the suspension between the webs, a first pressing section including at least one drum about a portion of which the pair of webs pass, a second pressing section located dowstream from the first pressing section and comprising a second press drum and pressure means applying pressure to the outer web relative to the press drum, outlet means located downstream from the second pressing section for removing a relatively dried suspension material, and means downstream from the first pressing section for separating from the pair of webs the web which runs opposite to said outer web relative to the press drum in the second pressing section. In a preferred embodiment, according to the invention, a third continuous web downstream of the first pressing section passes partly around the second press drum and constitutes the inner web of the pair of webs passing partly around the drum. Preferably a means is provided for controlling tension in the third web.

DESCRIPTION OF THE PREFERRED EMBODIMENTS

For a better understanding of the invention, reference is made to the following detailed description of the invention taken with reference to the accompanying drawing which is a schematic side view illustrating a representative embodiment of the present invention.

In the typical embodiment of the invention shown in the drawing, a suspension containing solid material to be separated from a liquid such as water is introduced into the press at an intake 10 between two liquid-pervious webs 11 and 12 moving in the direction of the arrows. An initial pressing of the suspension takes place in a first pressing section 13 comprising five press drums 14, 15, 16, 17 and 18, of successively smaller diameter about which the webs 11 and 12 and the enclosed layer of suspension material pass in succession. Since the pair of webs is under tension as it passes around the press drums, pressure is applied to the enclosed layer of material so as to squeeze out the liquid in which the solid material was suspended.

The liquid separated from the suspension during the initial pressing in the first section is removed from the web press by arranging appropriately located chutes or other suitable devices (not shown). If desired, the drums 14–18 may have perforated surfaces so as to permit liquid to be removed through the interior of the drums.

After passing the last press drum 18 of the first press section, the web 11 is separated from the suspension material and the web 12 by means of a series of guide rolls 19. One of these guide rolls, designated with the reference numeral 19*a*, is arranged as a tensioning roll, by means of which the web 11 is maintained under tension. The suspension remains on the web 12 which then passes toward a second pressing section 20.

The second pressing section 20 includes a press drum 21 which is preferably motor-driven. Before the web 12 carrying the suspension material engages the drum 21, another web 22 moving in the direction of the arrow is brought into contact with the suspension material, the web 22 being maintained under tension by means of a tensioning roll 23. The web 22 can either be pervious or impervious to liquid and, if it is pervious, the press drum 21 may, if desired, be perforated to permit removal of liquid from the interior of the drum.

The webs 12 and 22, with the suspension material between them, are guided around a substantial portion of the circumference of the press drum 21 and a high pressure is applied to the suspension material by means of a pressure belt device 24. The pressure belt device 24 is arranged to apply a substantially uniform high pressure to the webs 12 and 22 and comprises a continuous band, a plurality of spaced parallel belt members, a pervious mesh net or the like, pressing against web 12. The pressure belt device 24 is carried by three guide rolls 25, 25*a*, one of which, designated with the reference numeral 25*a*, is urged by appropriate means in the direction of the arrow in order to apply high pressure to the belt device 24 and thereby to the webs 12 and 22 and the layer of suspension material between them. A typical web press having a pressure belt device is shown and described in my U.S. Pat. No. 4,172,416.

The dried suspension material is carried out on the web 22 at the outlet 26 and the web 12 is removed from the suspension material by means of a series of guide rolls 27, 27*a*. One of these guide rolls, designated with the reference numeral 27*a*, is a tension roll arranged to apply tension to the web 12.

In operation, the improved web press according to this invention provides highly effective removal of liquid from suspension. A liquid suspension, introduced at the inlet 10, is carried out by the webs 11 and 12 around the press drums 14–18 of the first press section 13. Since the press drums 14–18 have decreasing diameters in the downstream direction of the webs 11 and 12, successively increased pressure is applied to the suspension material in the first section 13, providing the highest degree of liquid removal at the last press drum 18. According to the invention, accumulation or build-up of the web 11 at the entrance to the second press section 20, which would otherwise occur because of the shorter path of the inner web than the outer web around the press drum 21, is avoided by removing the web 11 at the end of the first press section 13 and introducing the web 22 at the entrance to the second press section 20 to provide an inner web around the drum 21 which moves independently of the web 11.

In the second press section 20, higher pressure is applied to the suspension material carried between the webs 12 and 22 by the pressure belt device 24, thereby drying the suspension material to an even greater extent without, however, causing any accumulation of the inner web at the entrance to the second pressure section. Because of the ability to apply such high pressure to relatively thick layers of suspension material without difficulty, the web press of the invention is especially suited to drying materials such as peat.

It should be understood that this invention is not limited to the particular embodiments described above but is intended to encompass all modifications in form and detail falling within the scope of the following claims. Thus, for example, the third web 22 may be omitted entirely and the suspension material may be carried through the second press section by only the web 12 which is the outer web with respect to the drum 21, a doctor blade or scraper (not shown) being provided to remove any material adhering to the drum 21. In addition, the first section of the liquid removing apparatus can consist of other liquid removing means than the pressure section described above. For instance a liquid removing arrangement as described and shown in U.S. Pat. No. 3,891,549 provided with two webs and at least one drum for the separation of one of the webs from the suspension may be provided. Also, the arrangement for providing increased pressure in the second pressing section 20 can comprise any other known device for applying further pressure.

I claim:

1. Apparatus for removing liquid from a suspension comprising a pair of continuous webs movable over a portion of their length along a common path having an upstream end for introducing the suspension between the webs, a first pressing section including at least a first press drum about a portion of which the pair of webs pass, a second pressing section located downstream from the first pressing section and comprising a second press drum and pressure means for applying pressure to the outer web relative to the second press drum, outlet means located downstream from the second pressing section for removing a relative dried suspension material, and means for separating one of the pair of webs from the other web of the pair downstream of the first pressure section and prior to the second pressure section, the other web of the pair passing as the outer web to carry the suspension material around a portion of the second press drum to the outlet means.

2. Apparatus for removing liquid from a suspension comprising a pair of continuous webs movable over a portion of their length along a common path having an upstream end for introducing the suspension between the webs, a first pressing section including at least a first press drum about a portion of which the pair of webs pass, a second pressing section located downstream from the first pressing section and comprising a second press drum and pressure means for applying pressure to the outer web relative to the second press drum, outlet means located downstream from the second pressing section for removing a relatively dried suspension material, means for separating one of the pair of webs from the other web of the pair downstream of the first pressure section and prior to the second pressure section, the other web of the pair passing as the outer web to carry the suspension material around a portion of the second press drum, and a further continuous web which passes as an inner web around a portion of the second press drum.

3. Apparatus according to claim 2 comprising means for applying controlled tension to the further continuous web.

4. Apparatus for removing liquid from a suspension comprising a pair of continuous webs movable over a portion of their length along a common path having an upstream end for introducing the suspension between the webs, a first pressing section including a plurality of successive press drums of decreasing diameter in the direction of motion of the pair of webs about a portion of which the pair of webs pass, a second pressing section located downstream from the first pressing section and comprising a second press drum and pressure means for applying pressure to the outer web relative to the second press drum, outlet means located downstream from the second pressing section for removing a relatively dried suspension material, and means for separating one of the pair of webs from the other web of the pair downstream of the first pressure section and prior to the second pressure section, the other web of the pair passing as the outer web to carry the suspension material around a portion of the second press drum.

5. Apparatus according to claim 1 wherein the pressure means comprises pressure belt means engaging the outer web over a substantial portion of the circumference of the second press drum to apply increased pressure thereto.

* * * * *